US010226091B2

(12) United States Patent
Cowan et al.

(10) Patent No.: US 10,226,091 B2
(45) Date of Patent: Mar. 12, 2019

(54) SECURITY POCKET

(71) Applicant: NIKE, Inc., Beaverton, OR (US)

(72) Inventors: Christine Cowan, Beaverton, OR (US); Luke Hammer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 111 days.

(21) Appl. No.: 15/384,760

(22) Filed: Dec. 20, 2016

(65) Prior Publication Data

US 2017/0202286 A1 Jul. 20, 2017

Related U.S. Application Data

(60) Provisional application No. 62/279,419, filed on Jan. 15, 2016.

(51) Int. Cl.

| | |
|---|---|
| ***A41D 27/20*** | (2006.01) |
| ***A41D 1/06*** | (2006.01) |
| ***A41D 3/00*** | (2006.01) |
| *A41D 27/00* | (2006.01) |

(52) U.S. Cl.

CPC ..... *A41D 27/201* (2013.01); *A41D 1/06* (2013.01); *A41D 3/00* (2013.01); *A41D 2300/32* (2013.01)

(58) Field of Classification Search

CPC ..... A41D 27/20; A41D 20/00; A41D 27/205; A41D 27/208; A45F 5/00; A45F 2005/008; A45F 2200/055; A45F 2200/0516; A45F 5/022; A45F 5/02; A44C 5/003; A45C 11/182; A45C 11/04; A45C 13/08; A45C 1/06; A45C 2001/026; A45C 3/001; G09F 21/02; G09F 3/207

See application file for complete search history.

(56) References Cited

U.S. PATENT DOCUMENTS

| | | | | |
|---|---|---|---|---|
| 3,537,108 A | | 11/1970 | Daniels | |
| 4,365,354 A | * | 12/1982 | Sullivan | A41D 13/01 2/171 |
| 4,451,935 A | * | 6/1984 | Henschel | A42B 1/241 2/181 |

(Continued)

OTHER PUBLICATIONS

"SCOTTeVEST Alpha Jacket," Think Geek, thinkgeek.com http://www.thinkgeek.com/product/164c/.

(Continued)

*Primary Examiner* — Robert H Muromoto, Jr.
(74) *Attorney, Agent, or Firm* — Shook, Hardy & Bacon L.L.P.

(57) ABSTRACT

A fold-over security pocket is provided herein. The fold-over security pocket includes a panel having a first portion including an inner-facing surface that is overlaid with fasteners, a second portion including an inner-facing surface that is overlaid with complementary fasteners, and a hinge portion separating the first portion from the second portion. At least one of the inner-facing surfaces has a slit opening which extends into an interior space, so that an item may be inserted into the slit opening and stowed in the space. The hinge portion is flexible and enables the first portion to be folded over onto the second portion so that the inner-facing surfaces meet, and the fasteners mate with the complementary fasteners, thereby securing the pocket in a closed configuration as well as any item inserted into the space via the slit opening.

20 Claims, 7 Drawing Sheets

(56) References Cited

U.S. PATENT DOCUMENTS 4,625,340 A * 12/1986 Hernandez ..... A41D 27/20 2/247
5,155,869 A * 10/1992 Ralli ..... A41D 27/20 2/247
5,590,760 A * 1/1997 Astarb ..... A45C 11/04 206/5
5,724,678 A * 3/1998 McCallum ..... A42B 1/241 2/181
5,887,287 A * 3/1999 Potochnik ..... A42B 1/067 2/172
D419,282 S * 1/2000 Nickle ..... D2/857
6,233,747 B1 * 5/2001 Barker ..... A41D 27/20 2/247
6,397,398 B1 * 6/2002 Herder ..... A41D 27/20 2/249
6,810,529 B1 * 11/2004 Reilly ..... A41D 27/20 2/247
D608,983 S * 2/2010 Myers ..... D2/857
7,753,759 B2 * 7/2010 Pintor ..... A41C 3/0035 450/54
8,413,613 B1 * 4/2013 Smith ..... A01K 27/003 119/797
8,850,621 B2 * 10/2014 Carter-Cohen ..... A45F 5/022 2/300
D718,935 S * 12/2014 Hyzdu ..... D3/303
D719,732 S * 12/2014 Hyzdu ..... D3/303
2005/0114988 A1 * 6/2005 Dow ..... G09F 21/02 2/247
2008/0189832 A1 * 8/2008 Oscher ..... A41B 9/002 2/400
2012/0266360 A1 * 10/2012 McElrath ..... A45C 1/04 2/170
2013/0086819 A1 * 4/2013 LeGear ..... A43B 23/00 36/136
2013/0174320 A1 * 7/2013 Moye ..... A41D 20/00 2/170
2013/0305778 A1 * 11/2013 Franco ..... A44C 5/003 63/1.14
2015/0374048 A1 12/2015 Theodossiou

OTHER PUBLICATIONS

"Sporteer Armband for iPhone 5S/5C/5—M/L," Amazon, amazon.com, Seller: Sporteer. http://www.amazon.com/Sporteer-Armband-iPhone-5S-5C/dp/B009ECXK48?ie=UTF8&ref_=de_a_smtd &showDetaiiTechData = 1 #technica 1-data.
"Gracies's Gear Sports Bra," gracie's gear, graciesgearandtraining.com https://www.graciesgearandtraining.com/store/sports-bra-pocket-pink/.
"Velocity Run Jacket," Sweaty Betty, sweatybetty.com, code: SB320. http:///www .sweatybetty.com/velocity-run-jacket/.
International Search Report and Written Opinion dated Mar. 17, 2017 in International Patent Application No. PCT/US2017/013331, 11 pages .
International Preliminary Report on Patentability dated Jul. 26, 2018 in International Patent Application No. PCT/US2017/013331, 9 pages.

* cited by examiner

SECURITY POCKET

CROSS-REFERENCE TO RELATED APPLICATIONS

This nonprovisional application entitled "Security Pocket" claims the benefit of U.S. Provisional Application No. 62/279,419, entitled "Security Pocket" and filed on Jan. 15, 2016, the entirety of which is incorporated herein.

STATEMENT REGARDING FEDERALLY SPONSORED RESEARCH OR DEVELOPMENT

Not applicable.

TECHNICAL FIELD

The present invention relates to a fold-over security pocket that may be integrated with a garment.

BACKGROUND

Generally, conventional pockets include an opening to a pouch-like space for stowing items and placing a user's hand therein for warmth. The boundaries of the pouch-like space are typically defined by different panels of a garment. During ambulation, stowed items move freely within the pouch. Based on the level of ambulation or activity, the items may move substantially and with force around the pouch-like space. The movement of the items may cause the items to pull, tug, and move the pocket and portions of the garment, resulting in annoyance to a user. And, in some instances, the items may eventually free themselves from the confines of the pouch through the opening, resulting in loss or damage to the items.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Aspects described herein relate to a security pocket. The security pocket may include a panel of fabric or other material comprising several portions. A first portion is overlaid with fasteners (such as hook fasteners), a second portion includes complementary fasteners (such as loop fasteners) and a slit opening to a storage space within the panel, and a flexible hinge portion separates the first and second portions. The flexible hinge portion enables the first and second portions to fold over onto one another, engaging the fasteners and securing the slit opening as well as any items stored in the storage space. For example, a user may use the hinge portion to fold the first portion having fasteners over onto the second portion having the complementary fasteners, and further, use a downward pressure of force to ensure that the fasteners are fully engaged in order to secure the pocket. And the user may employ a peeling motion to disengage the fasteners of the first portion from the second portion and open the security pocket.

In aspects, fasteners overlay all or substantially all of an inner-facing surface of the first portion, and complementary fasteners overlay all or substantially all of an inner-facing surface of the second portion, where the inner-facing surface of the second portion has one or more slit openings providing access to a storage space in the panel. When the security pocket is in an open state, the slit opening(s) is/are accessible to a user who may place items into the storage space via the opening(s). The security pocket may be closed by folding the first portion over the second portion so that the inner-facing surface of the first portion contacts the inner-facing surface of the second portion. This contact results in the fasteners engaging the complementary fasteners and causes the slit opening(s) of the second portion to be overlaid or covered by the inner-facing surface of the first portion. Thus, any items stored within or partially within the slit openings are secured.

The fasteners of the inner-facing surfaces provide a robust closure of the security pocket due to their number and extensive coverage of the inner-facing surfaces. As such, to open the closed security pocket necessitates breaking many individual fastener-complementary-fastener connections across the inner-facing surfaces of the first and second portions. In contrast, in a conventional pocket, a single snap-closure at a single location might need to be opened to provide access to stored items. The single closure can be accidently or inadvertently opened during activity, resulting in the loss or damage of stored items. In contrast, the security pocket described herein leverages each of the plurality of fastener connections to provide a stronger connection across all or substantially all of the inner-facing surfaces. In this way, the high number of fastener connections (e.g., approximately 300 loops may be engaged by 300 hooks per square inch of surface area) as well as the distribution of the fastener connections across all or substantially all of the surface provides a superior and stronger closure than a conventional pocket. Items stored in the security pocket move less during activity and are less likely to be lost or damaged as well.

In one aspect, a security pocket is provided. The security pocket comprises a panel having a first portion, a second portion, and a hinge portion separating the first portion and the second portion. In aspects, the first portion comprises an inner-facing surface and an outer-facing surface. The majority of the inner-facing surface of the first portion is overlaid with one of hook fasteners or loop fasteners, in aspects. The second portion comprises an inner-facing surface and an outer-facing surface, as well. And, in aspects, the majority of the inner-facing surface of the second portion is overlaid with fasteners that are complementary to the fasteners of the first portion. The inner-facing surface of the second portion comprises one or more slit openings extending into a space formed between the inner-facing surface and the outer-facing surface of the second portion, in aspects. The hinge portion is adapted to enable the first portion to be folded over onto the second portion such that the fasteners of the first portion engage the fasteners of the second portion.

In another aspect, a garment having a security pocket is provided. The garment comprises at least one fabric panel configured to cover at least an upper torso area of a wearer or a lower torso area of the wearer when the garment is in an as-worn configuration. The security pocket is affixed to the at least one fabric panel, in aspects. The security pocket comprises a panel having a first portion, a second portion, and a hinge portion separating the first portion and the second portion. And the first portion comprises an inner-facing surface and an outer-facing surface. In aspects, at least 80% of the inner-facing surface of the first portion is overlaid with one of hook fasteners or loop fasteners. The second portion comprises an inner-facing surface and an outer-facing surface. The majority of the inner-facing surface of the second portion, in aspects, is overlaid with fasteners that are complementary to the fasteners of the first portion. And the inner-facing surface of the second portion comprises one or more slit openings extending into a space formed between the inner-facing surface and the outer-facing surface of the second portion. In aspects, the hinge portion is adapted to enable the first portion to be folded over onto the second portion such that the one of hook fasteners or loop fasteners of the first portion engage the fasteners of the second portion that are complementary to the fasteners of the first portion. When the panel is in a closed configuration, the contact of the first portion and the second portion limits access to at least one of the one or more slit openings of the second portion, in aspects.

In a further aspect, a fold-over security pocket for stowing items is provided. The security pocket comprises a panel adapted to be affixed to a garment. The panel has a first portion, a second portion, and a hinge portion that separates the first portion and the second portion. The first portion comprises an inner-facing surface and an outer-facing surface. At least 90% of the inner-facing surface of the first portion is overlaid with hook fasteners, in aspects. And the second portion comprises an inner-facing surface and an outer-facing surface. At least 90% of the inner-facing surface of the second portion is overlaid with loop fasteners, in aspects. The inner-facing surface of the second portion further comprises one or more slit openings extending into a space formed between the inner-facing surface and the outer-facing surface of the second portion. In aspects, the one or more slit openings are sized to receive an item for stowing in the space. The hinge portion is adapted to facilitate a closed configuration. In the closed configuration of the security pocket, the hinge portion enables the first portion to be folded over onto the second portion such that the hook fasteners of the first portion engage the loop fasteners of the second portion. And, in the closed configuration, the one or more slit openings of the second portion are overlaid by the first portion.

BRIEF DESCRIPTION OF THE DRAWINGS

The present aspects are described in detail below with reference to the attached drawing figures, wherein.

DETAILED DESCRIPTION

Present aspects have been described herein, which are intended in all respects to be illustrative rather than restrictive. Alternative aspects will become apparent to those of ordinary skill in the art to which the present aspects pertain without departing from its scope. From the foregoing, it will be seen that aspects herein are well adapted to attain all the ends and objects set forth above, together with other advantages which are obvious and inherent. It will be understood that certain features and subcombinations are of utility and may be employed without reference to other features and subcombinations. This is contemplated by and is within the scope of the claims.

Figure 1:
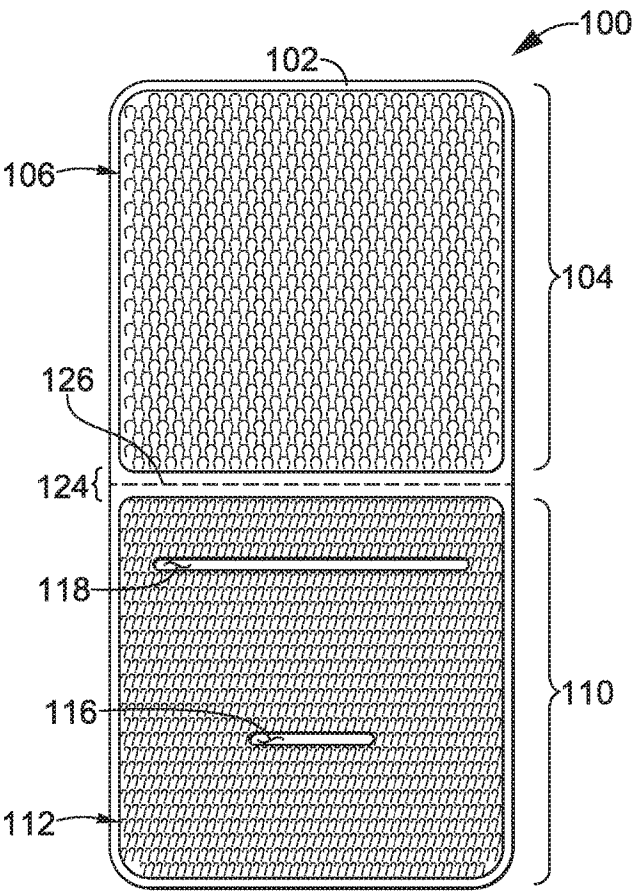
FIG. 1 depicts a plan view of an exemplary security pocket in accordance with an aspect herein.

Beginning with FIG. 1, FIG. 1 depicts a plan view of an exemplary security pocket 100. As shown, the security pocket 100 is in an open configuration and lies substantially flat or planar. The security pocket 100 comprises a panel 102. In aspects, the panel 102 is adapted to be releasably affixed to a garment. For instance, the panel 102 may comprise some type of releasable fastener (e.g., buttons, snaps, hood-and-loop fasteners, a releasable adhesive, and the like) that enables the panel 102 to be secured to different garments when needed. In another aspect, the panel 102 is integrally formed with a garment and/or is permanently affixed to the garment. All types of garments are contemplated to be within the scope of this disclosure. Illustrative non-limiting garments may include a running jacket, a running pant, a tank top, a shirt, a compression short, and the like. The panel 102 may comprise fabric or other material suitable for constructing a garment, in aspects. Exemplary fabrics and/or materials may include knits, mesh, moisture-wicking fabrics, cotton, jersey, materials employing synthetic fibers, thermo-regulating fabrics, stretchable fabrics, and stiffening materials. In some aspects where the panel 102 is separate from and adapted to be releasably affixed to a garment, the panel 102 may be formed from a fabric and/or material having increased durability and/or a heavier fabric weight, such as twill, canvas, duck cloth, broadcloth, wool blends, or leather. In this way, the panel 102 is durably constructed to withstand attachment and detachment from the garment many times over. And in some aspects where the panel 102 is integrally formed with a garment, the panel 102 may be formed from the same or a similar fabric and/or materials as the garment. Alternatively, an integrally formed panel might be constructed of one or more materials that are different from the garment.

As shown in FIG. 1, the panel 102 is generally rectangular in shape; however, it will be understood that the panel 102 may be any shape. Further, the size of the panel 102 may be determined relative to a garment size (e.g., a child size jacket or adult men size jacket), a type of garment (e.g., a pant or a jacket), and/or the placement of the panel 102 as affixed to said garment (e.g., placement on a sleeve or a waistband).

The panel 102 includes a first portion 104 generally indicated by a bracket in FIG. 1. The first portion 104 includes an inner-facing surface 106 and an outer-facing surface 108 (see, e.g., FIG. 3). Inner and outer may be used herein to describe a surface with respect to the security pocket itself, such that an inner surface corresponds to an interior of the security pocket 100 and an outer surface corresponds to the exterior of the pocket 100. It will generally be understood that interior portions of security pocket 100 correspond to areas for stowing items (e.g., items are stowed inside pockets and the exterior of pockets protects the items held within). As shown in FIG. 1, the first portion inner-facing surface 106 is overlaid with loop fasteners. In another aspect, the first portion inner-facing surface 106 is overlaid with hook fasteners. And, in a further aspect, the first portion inner-facing surface 106 is overlaid with a combination of hook fasteners and loop fasteners. Other types of fastener systems are contemplated herein. For instance, instead of hood-and-loop fasteners, the fasteners may comprise a releasable adhesive, buttons, snaps, and the like.

Generally, the majority of the first portion inner-facing surface 106 is overlaid with one of hook fasteners or loop fasteners, in aspects. As used herein, the term 'majority' refers to a percentage of the exposed surface area that is at least greater than fifty percent. In one aspect, a majority refers to a percentage of a surface area greater than or equal to sixty percent, seventy-five percent, eighty percent, ninety percent, or values in between. In another aspect, a majority refers to one-hundred percent, all, or substantially all of a surface area. And, in another aspect, a majority may refer to all or substantially all of the surface area less any areas of the surface that correspond to one or more of an opening and/or a perimeter edge.

The panel also includes a second portion 110 generally indicated by another bracket in FIG. 1. The second portion 110 includes an inner-facing surface 112 and an outer-facing surface 114 (see, e.g., FIG. 4). The second portion inner-facing surface 112 is overlaid with hook fasteners, loop fasteners, or a combination thereof, in aspects. As shown in FIG. 1, the second portion inner-facing surface 112 is overlaid with hook fasteners. Generally, the second portion inner-facing surface 112 is overlaid with fasteners that are complementary to, and which are capable of engaging with, the fasteners which overlay the first portion inner-facing surface 106. Complementary fasteners, as used herein, refer to fasteners that are configured to engage, mate with, and/or connect to fasteners of the first portion 104. For example, a hook fastener is complementary to a loop fastener. In another example, a micro-loop fastener is complementary to a micro-hook fastener, such as those exemplary fasteners of the snapping fabric described in U.S. Pat. No. 7,231,789 to Chou. Fasteners and their complementary fasteners, as described herein, are considered to include fasteners that are integrally formed from the weave, knit, and/or fiber(s) of the material and/or fabric itself as well as fasteners that are incorporated or added to the material and/or fabric, in various aspects. It will be understood that although the fasteners may be described as complementary, in some aspects, the first and second portions 104 and 110 may have the same fasteners or uniform fasteners so long as the fasteners are configured to mate together and/or otherwise engage one another. In aspects, a majority of the second portion inner-facing surface 112 is overlaid with said complementary fasteners.

The second portion inner-facing surface 112 comprises one or more slits or openings 116 and 118. In some aspects, an area directly adjacent to or surrounding the openings 116 and 118 may not be overlaid with, or be otherwise devoid of, any fasteners. In the aspect shown in FIG. 1, the one or more openings 116 and 118 are slit-type openings that have a narrow and elongated shape such that each of the one or more slit openings 116 and 118 is longer than it is wide. Openings of varying size and shape are contemplated to be within the scope of the invention, and the one or more slit openings 116 and 118 shown in FIG. 1 should not be construed to be limiting. As such, the openings might be the same, similar, or different in size and shape. Any number of openings may be employed, and further, the number of openings may be determined based on the size and shape of the second portion 110 and/or the panel 102. Further, although the one or more slit openings 116 and 118 are shown as being placed and located nearly parallel to one another and spanning the second portion inner-facing surface 112 horizontally from left to right, it will be understood that other orientations (e.g., rotated, non-parallel to one another), placements (e.g., placed nearer the interior of the second portion 110, placed at or nearer an edge of the second portion 110), and groupings are contemplated to be within the scope of this disclosure.

The size, shape, orientation, placement, number, and/or grouping of the one or more slit openings 116 and 118 may be specialized for stowing specific items that have predictable, well-known, or standard dimensions. Items such as credit or debit cards, a driver's license, a key, or coins have somewhat standard dimensions and, further, may be oriented to be substantially thin or flat (e.g., placed so that a planar side of the item is laid parallel to a flat surface). As such, in aspects, one or more of the slit openings 116 and 118 are sized to receive items for stowing, wherein the items may be inserted or partially inserted into the one or more slit openings 116 and 118 such that the items lay flat or are substantially parallel to (or in a planar relationship with) the second portion inner-facing surface 112.

Figure 2:
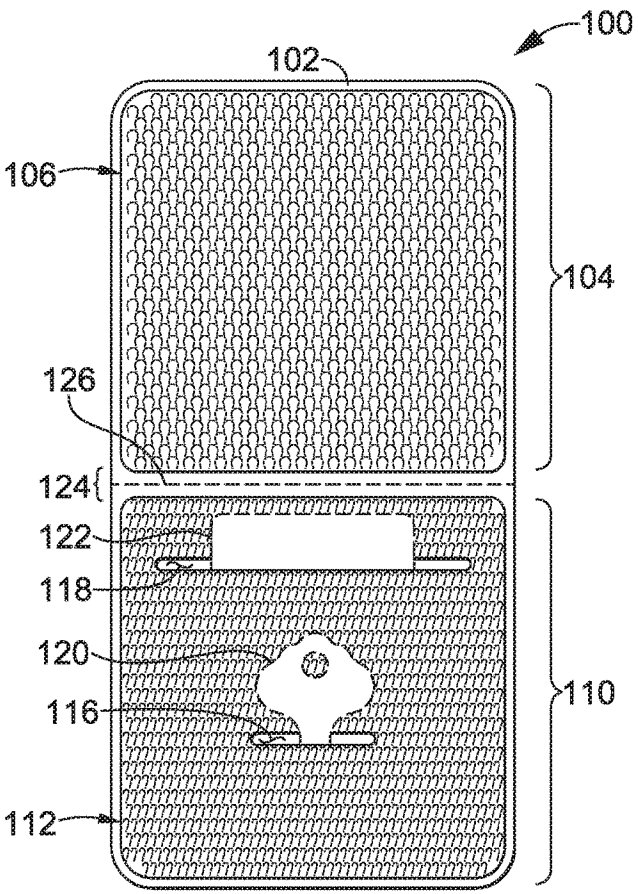
FIG. 2 depicts a plan view of the security pocket of FIG. 1 in accordance with an aspect herein.

For example, a key 120 might be inserted into the opening 116, as indicated by the dashed outline of a key 120 shown in FIG. 2. When positioned within the opening 116, the key 120 is held in place and lays flat. Moreover, since a portion of the key 120 is left exposed, the key 120 may be easily removed from the opening 116. Additionally or alternatively, a credit card might be inserted into the opening 118 as indicated by the dashed outline of a credit card 122 shown in FIG. 2. After being positioned within the opening 118, the credit card 122 lays flat relative to the second portion inner-facing surface 112. Similar to the key 120, a portion of the credit card 122 is left exposed allowing the credit card 122 to be easily accessed. In some aspects, the size, shape, orientation, placement, number, and/or grouping of one or more of the slit openings 116 and 118 may be generalized (e.g., not specialized) so that the openings 116 and 118 are capable of stowing various items without discrimination. The key and credit card examples should not be construed as limiting the size of the openings 116 and 118 and/or the security pocket 100 described herein. Furthermore, the outlined shapes simply indicate where a key and/or credit card might be inserted into an opening and held therein such that a portion of said items extend outward from the opening. The outlined shapes of the example items, as shown, do not indicate a lack of hook and/or loop fasteners, however. Rather, the outlined shapes of the example items are included merely as a visual aid.

As depicted in FIGS. 1 and 2, the size and shape of the first portion 104 may be similar to, or be the same as the second portion 110 in some aspects. And the size and shape of the first portion inner-facing surface 106 and the second portion inner-facing surface 112 may be the same or similar. In further aspects, the proportion of the first portion inner-facing surface 106 that is overlaid with fasteners may be the same or similar size and shape to the proportion of the second portion inner-facing surface 112 that is overlaid with complementary fasteners. For example, as indicated in FIG. 1, the size and shape of the first portion 104 is the same or substantially the same as the second portion 110. And the areas of the first portion 104 corresponding to the majority of the first portion inner-facing surface 106 overlaid with fasteners are similar in size and shape to the areas of the second portion 110 overlaid with complementary fasteners, as illustrated in FIG. 1. In exemplary aspects, the edges of the second portion inner-facing surface 112 may lack fasteners, where the edges correspond to the outer perimeter of the second portion 110. Similarly, the edges of the first portion inner-facing surface 106 may also lack fasteners.

As illustrated in FIG. 1, the first portion 104 and the second portion 110 may be symmetrical, in some aspects, with respect to a hinge portion 124. In such an aspect, the hinge portion 124 is shown as having an axis 126 about which symmetry may be measured. The axis 126 is only included herein as a visual aid. In FIG. 1, the axis 126 bisects or substantially bisects the panel 102. However, it will be understood by those in the art that the first and second portions 104 and 110 may not be symmetrical in some aspects and, further, that the axis 126 of the hinge portion 124 might not bisect the panel 102.

Continuing, the hinge portion 124 separates the first portion 104 and the second portion 110, in aspects. In other words, the hinge portion 124 separates the first portion 104 from the second portion 110 such that the hinge portion 124 is a portion of the panel 102 that connects the first portion 104 to the second portion 110. In exemplary aspects, the hinge portion 124 does not include hook fasteners or loop fasteners (or other fasteners contemplated herein). Alternatively, in other aspects, the hinge portion 124 may include hook fasteners or loop fasteners. For instance, in one alternative aspect, the hinge portion 124 includes the same fasteners as the first portion inner-facing surface 106. In another alternative aspect, the hinge portion 124 includes the same complementary fasteners as the second portion inner-facing surface 112. In yet another aspect, the hinge portion 124 may include the same fasteners as both the first portion inner-facing surface 106 and the second portion inner-facing surface 112. Any and all aspects, and any variation thereof, are contemplated as being within the scope herein.

The hinge portion 124 generally comprises a flexible material or fabric. In aspects, the hinge portion 124 is constructed of the same fabric or material as the panel 102 and the flexible characteristic of the hinge portion 124 may be due to the lack of hook fasteners or loop fasteners at the hinge portion 124. Alternatively, the hinge portion 124 may be constructed from a fabric or material that is different than the remaining portions of the panel 102, such as the first and second portions 104 and 110, where the different fabric or material contributes to the flexible characteristics of the hinge portion 124. The hinge portion 124 is adapted to enable the first portion 104 to be folded over onto the second portion 110 such that the fasteners of the first portion inner-facing surface 106 engage the complementary fasteners of the second portion inner-facing surface 112. In aspects, the hinge portion 124 may be manipulated by a user to toggle the security pocket 100 between an open configuration (see, e.g., FIG. 1) and a closed configuration (see, e.g., FIG. 3). For example, in FIG. 1, the security pocket 100 is in an open configuration. And, in the open configuration, the first portion 104 does not contact the second portion 110 such that the one or more slit openings 116 and 118 are accessible. Additionally or alternatively, in a partially open configuration, the first portion 104 may contact at least part of the second portion 110 such that at least one of the one or more slit openings 116 and 118 remains accessible. As referred to herein, accessible and accessibility refer to the ability of a user to insert items into an opening and/or retrieve items stowed in the security pocket 100 via an opening.

Figure 3:
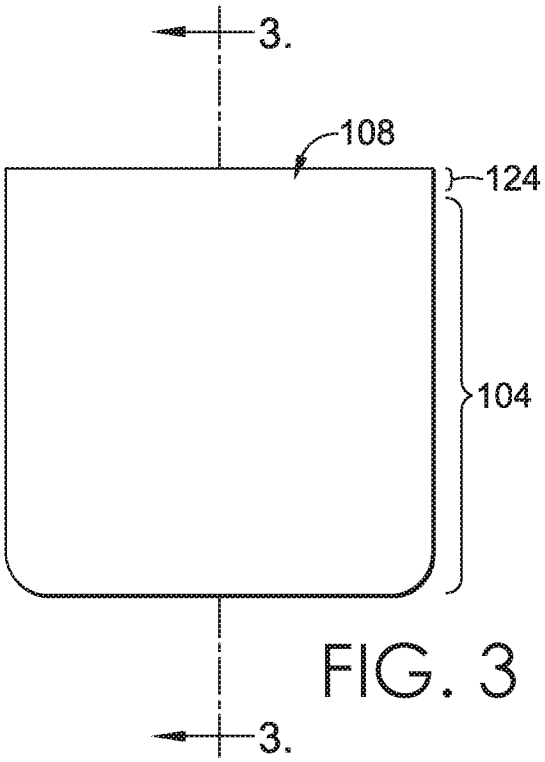
FIG. 3 depicts a plan view of the security pocket of FIG. 1 in a closed configuration in accordance with an aspect herein.

Accordingly, when the security pocket 100 is in a closed configuration, as illustrated in FIG. 3, the flexibility of the hinge portion 124 enables the first portion 104 to be folded over onto the second portion 110 so that the first portion inner-facing surface 106 contacts the second portion inner-facing surface 112 at areas or locations corresponding to the one or more slit openings 116 and 118. And, in the closed configuration, at least one of the one or more slit openings 116 and 118 may be entirely covered by the first portion 104. In other words, at least one of the one or more slit openings 116 and 118 is closed off or 'sandwiched' between the first portion and second portion inner-facing surfaces 106 and 112 and the engaged fasteners of each. In this way, the contact between and/or the engagement of the fasteners of the first portion inner-facing surface 106 and the complementary fasteners of the second portion inner-facing surface 112 limits access to one, more than one, or all of the one or more slit openings 116 and 118, in various aspects. Moreover, the contact of the first portion and second portion inner-facing surfaces 106 and 112 form a barrier or seal around any stowed item(s), which reduces movement of said item(s) when placed into the openings 116 and/or 118 of the security pocket 100. When the first portion 104 is folded over onto the second portion 110, a user may place pressure on the first portion outer-facing surface 108 to facilitate increased contact or more robust engagement of the fasteners of the first portion inner-facing surface 106 with the complementary fasteners of the second portion inner-facing surface 112, in aspects.

In aspects, the fasteners of the first portion inner-facing surface 106 may be releasably affixed to complementary fasteners of the second portion inner-facing surface 112, when the security pocket 100 is placed in a closed configuration. The term 'releasably affixed' refers to the fasteners' capability of being affixed and unaffixed many times over. In this way, releasably affixable fasteners, such as hook-and-loop fasteners, may be engaged and disengaged time and time again while retaining their fastening ability. Accordingly, a user may use the hinge portion 124 to fold the first portion 104 onto the second portion 110, apply a downward pressure to ensure the fasteners of each portion engage one another, and thus close the security pocket 100. And the user may open the security pocket 100 by applying an upward force and a peeling motion to disengage the fasteners of the portions 104 and 110 from one another.

Figure 4:
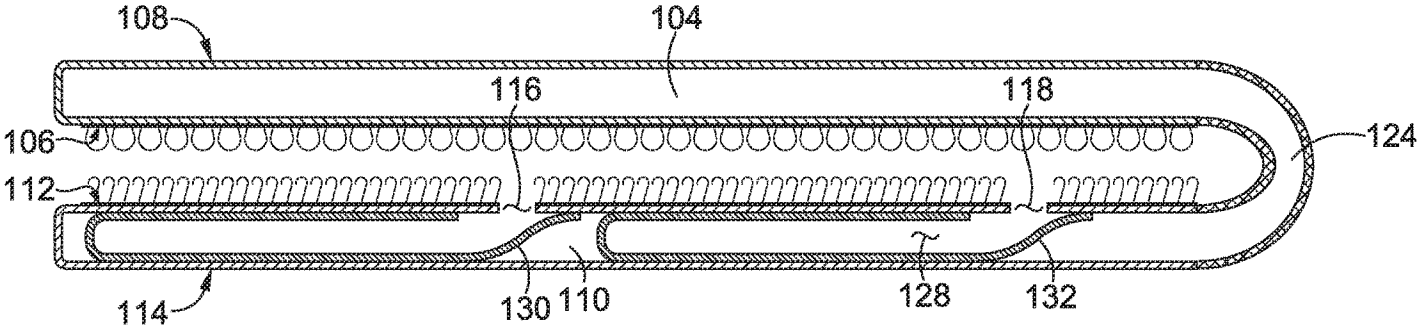
FIG. 4 depicts a cross section of the security pocket of FIG. 3 in the closed configuration in accordance with an aspect herein.

Turning to FIG. 4, FIG. 4 depicts a cross section of the security pocket 100 of FIG. 3, shown in a closed configuration and taken at cut line 3-3. As illustrated, the one or more slit openings 116 and 118 extend into a space 128 formed between the second portion inner-facing surface 112 and the second portion outer-facing surface 114. The volume of the space 128 is exaggerated in FIG. 4 for illustrative purposes, and it will be understood that when the space 128 is empty, the volume of the space 128 may be reduced so that the second portion inner-facing surface 112 lies adjacent to the second portion outer-facing surface 114.

Figure 5:
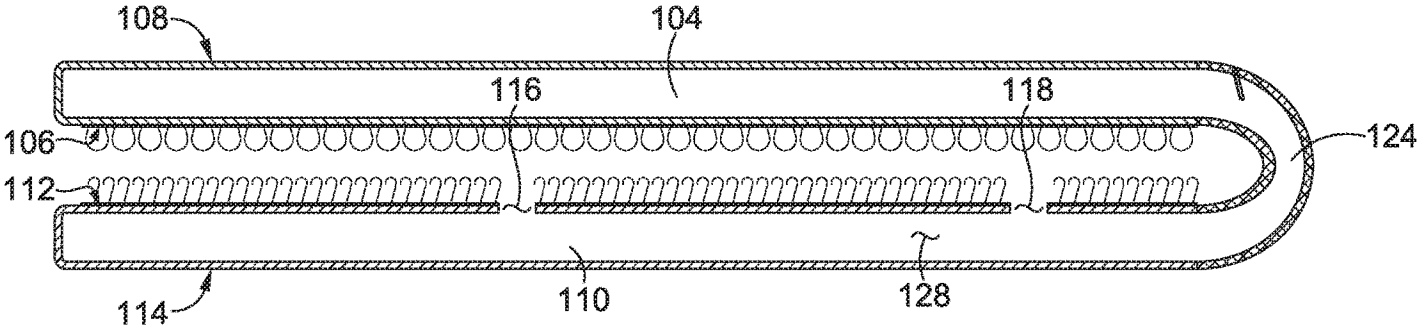
FIG. 5 depicts a cross section of another exemplary security pocket in accordance with an aspect herein.

The space 128 formed between the second portion inner-facing surface 112 and the second portion outer-facing surface 114 is configured to store items therein. In aspects, the one or more slit openings 116 and 118 provide access to the space 128 when the security pocket 100 is in an open configuration. However, it will be understood that items stowed in the space 128 may extend outward and/or protrude from one or more of the openings 116 and 118, as suggested by the outlined shapes of the items 120 and 122 shown in exemplary FIG. 2, for example. In exemplary aspects, the space 128 may be compartmentalized using a first divider 130 and a second divider 132. The first and second dividers 130 and 132 may be used to separate the space 128 into two parts, such that each part of the space 128 corresponds to one of the slit openings 116 or 118. The first and second dividers 130 and 132 may form a liner layer such that the space 128 is divided into two, and each of the one or more openings 116 and 118 that extend into the space 128 have a corresponding and separate liner layer. Alternatively, the space may not be compartmentalized and lack dividers, as shown in FIG. 5. In such an aspect, an item may be stowed in the space 128 as shared between the one or more openings 116 and 118. In another example, an item might be inserted into one opening (e.g., 116) for stowing in the space 128, such that a portion of the item protrudes from each of the one or more openings (e.g., 116 and 118) and a portion of the item occupies the space 128 between the one or more openings 116 and 118.

Figure 6:
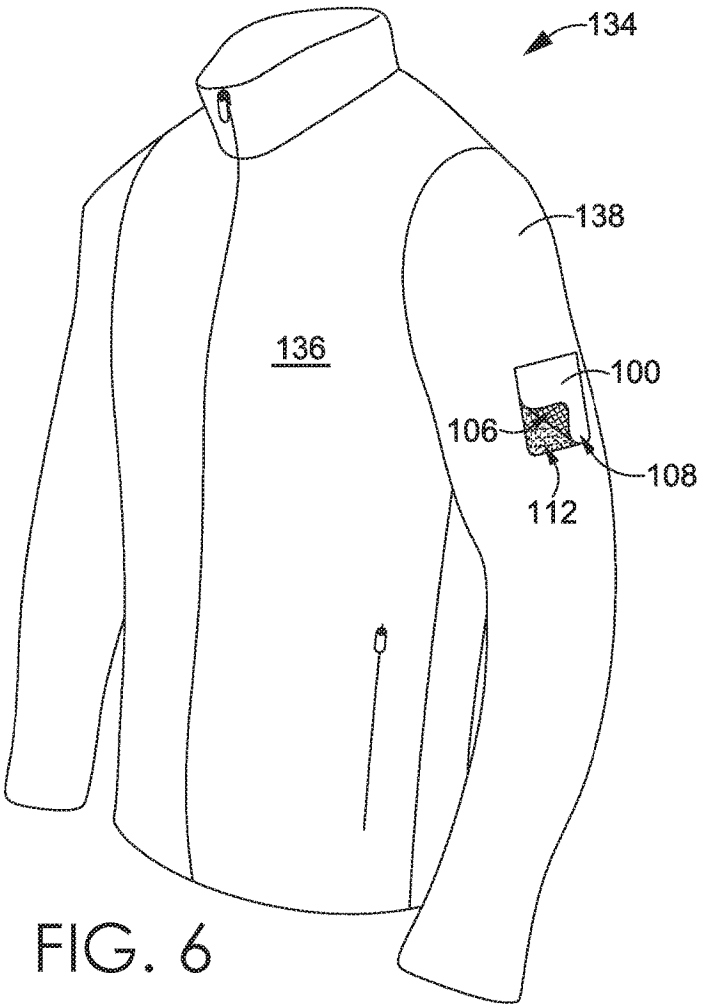
FIG. 6 depicts a jacket having an exemplary security pocket in accordance with an aspect herein.

At FIG. 6, a garment 134 having the security pocket 100 is shown. The garment 134 includes at least one fabric panel 136 to cover at least an upper torso area of a wearer when the garment 134 is in an as-worn configuration. The garment 134, as shown in FIG. 6, includes a fabric panel 138 forming a sleeve to which the security pocket 100 is affixed. In aspects, the outer-facing surface of the second portion (not shown in FIG. 6) is affixed to the fabric panel 138 of the garment 134. As discussed above, the pocket 100 may be permanently affixed or releasably affixed to the garment 134. For instance, when releasably affixed (via, for instance, buttons, snaps, a releasable adhesive, hook-and-loop fasteners, and the like), the pocket 100 can be worn when needed and removed when not needed. When permanently affixed, the pocket 100 may be integrally formed with the garment 134 or may be permanently affixed to the garment 134 via stitching, bonding, welding, and the like. Moreover, although the pocket 100 is shown as being affixed to the sleeve 138 of the garment 134, it is contemplated herein that the pocket 100 may be affixed to various other locations on the garment 134 such as the chest area, near the bottom margin, and the like. Any and all aspects, and any variation thereof, are contemplated as being within the scope herein.

Figure 7:
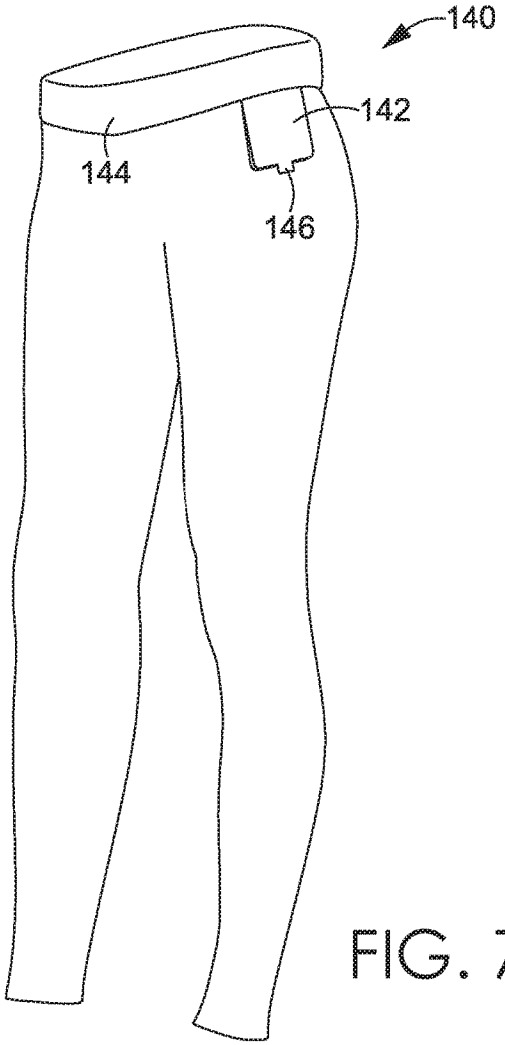
FIG. 7 depicts a pant having an exemplary security pocket in accordance with an aspect herein.

Similarly, FIG. 7 depicts another garment 140 having a fold-over security pocket 142. In the example shown in FIG. 7, the garment 140 is a running pant and the security pocket 142 is affixed to the garment 140 at or near a waistband 144 although other locations are contemplated herein. As shown, the fold-over security pocket 142 includes a tab portion 146. In aspects, the tab portion 146 is integrated with or connected to a first portion of the security pocket 142. In an exemplary aspect, the tab portion 146 is affixed to a portion of the security pocket 142 that does not include one or more openings on an inner-facing surface, for example. Alternatively, the tab portion 142 may be connected to a portion of the security pocket 142 having at least one opening on an inner-facing surface. In aspects, the tab portion 146 does not include any type of fastener mechanism such that it remains free-floating or unaffixed when the pocket 142 is in a closed configuration. As such, the tab portion 146 may be used to more easily open the pocket 142 by providing a "grab point" for pulling the pocket portions apart from one another.

Figure 8:
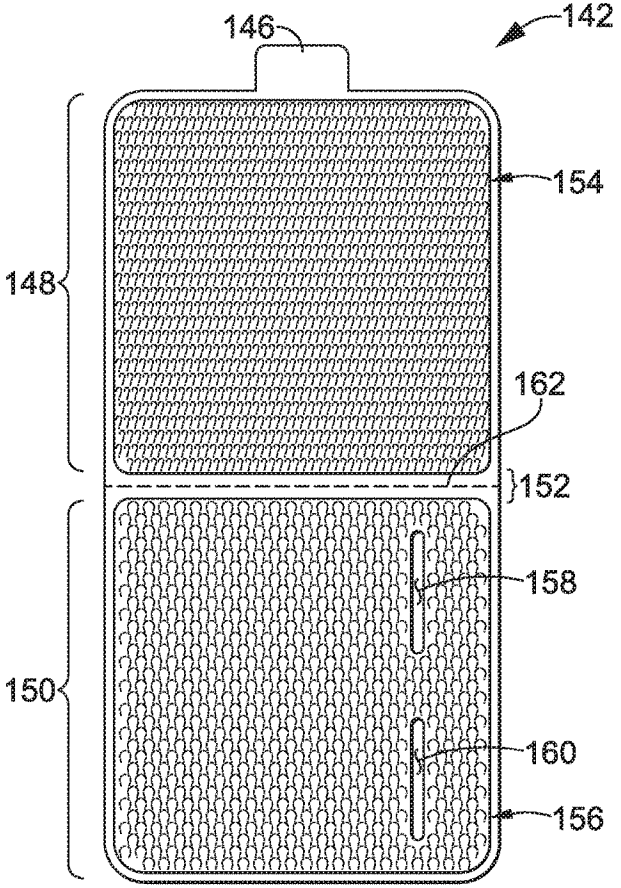
FIG. 8 depicts a plan view of the security pocket of FIG. 6 in accordance with an aspect herein.

FIG. 8 depicts the security pocket 142 of FIG. 7. The security pocket 142 includes a first portion 148 having the tab portion 146. The security pocket 142 also includes a second portion 150 and a hinge portion 152. In FIG. 8, the first portion 148 includes an inner-facing surface 154 having a majority overlaid with hook fasteners. The second portion 150 includes an inner-facing surface 156 that is overlaid with loop fasteners. As previously described herein, the hinge portion 152 enables the first portion 148 to be folded over onto the second portion 150 so that the hook fasteners may engage the loop fasteners such that the security pocket 142 is in a secure closed configuration. In this manner, access to one or more openings 158 and 160 of the second portion 150 becomes limited when in the closed configuration. Items may therefore be inserted into the one or more opening 158 and 160 for stowing in a space of the security pocket 142, as previously described herein. Similar to the security pocket 100, the first and second portions 148 and 150 are substantially symmetrical to one another in size and shape with respect to an axis 162 taken through the hinge portion 152.

As described above, the tab portion 146 is generally configured for manipulating the security pocket 142 from the closed configuration to the open configuration, and from the open configuration to the closed configuration. As shown in FIG. 8, the tab portion 146 does not include hook fasteners or loop fasteners. As such, similar to the exemplary hinge portion 124 shown in FIG. 1, the tab portion 146 is not overlaid with fasteners in some aspects. The tab portion 146 may lack fasteners in order to provide a surface for gripping the tab portion 146 and manipulating the opening and closing of the security pocket 142. In a further aspect, the tab portion 146 might include a snap fastener that provides extra security in maintaining the security pocket 142 in the closed configuration when engaged. With respect to this aspect, the snap fastener may mate with a similar snap fasteners located on a tab portion of the second portion 150 (not shown).

It will be understood that the exemplary garments of FIGS. 6 and 7 might incorporate one or more security pockets (e.g., security pockets 100 and 142) at any placement on the garments. For instance, a running jacket might include an exteriorly accessible security pocket placed on a sleeve near the shoulder as well as a second interiorly-placed security pocket placed at or near the upper torso in an as worn configuration. And it will be understood by those in the art that the number and placement of security pocket(s) may vary and are considered to be within the scope of this disclosure.

Figure 9:
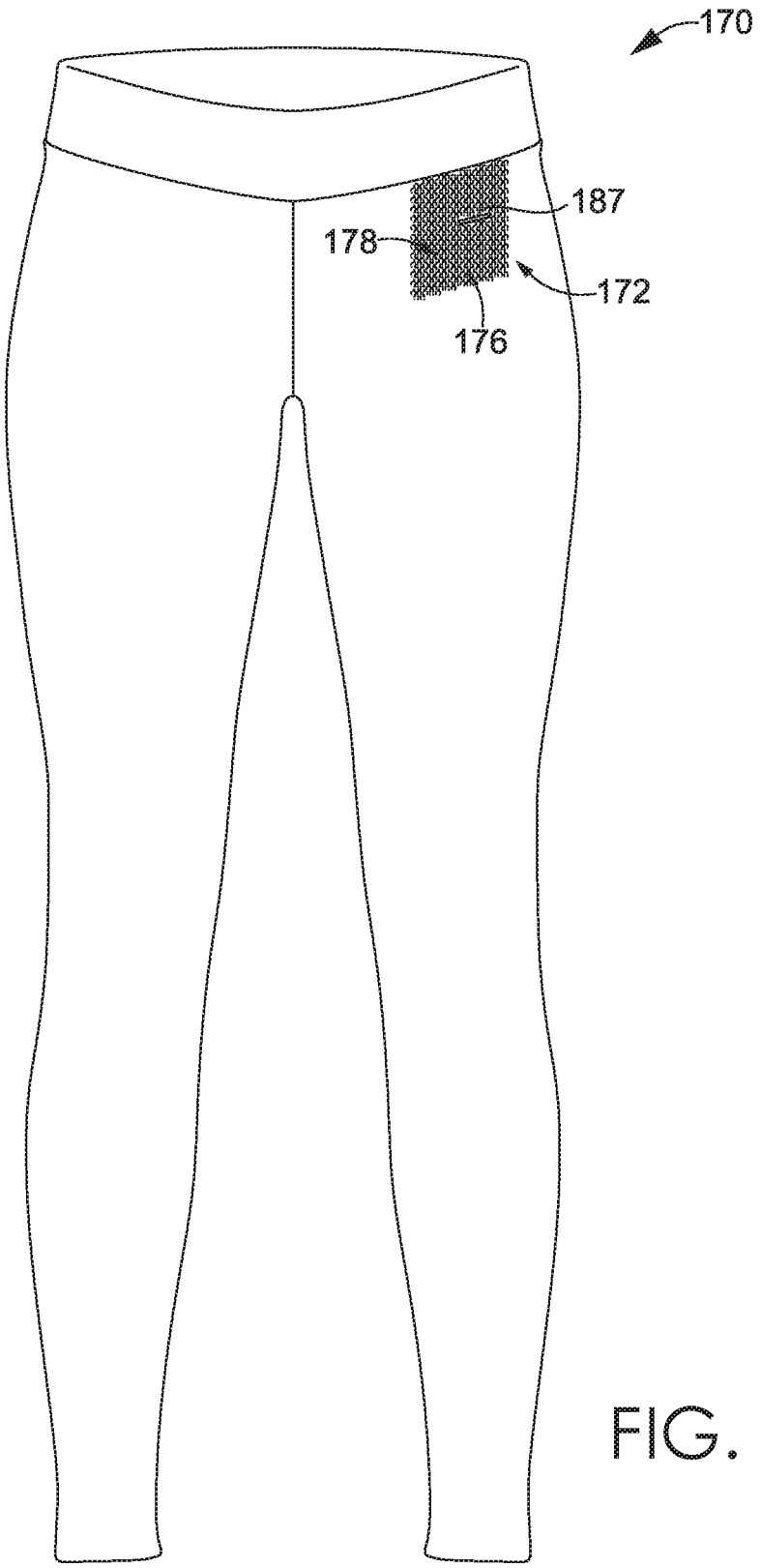
FIG. 9 depicts a pant having an exemplary partially integrated security pocket, in accordance with an aspect herein.
Figure 10:
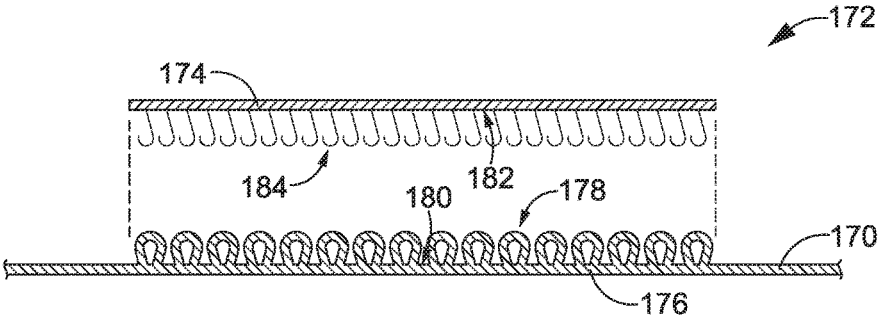
FIG. 10 depicts a cross section of the partially integrated security pocket of FIG. 9 and a separate panel of said security pocket, in accordance with an aspect herein.

Turning to FIG. 9, FIG. 9 depicts a pant 170 garment that includes a security pocket 172, as shown in the cross section of FIG. 10. As shown in FIGS. 9 and 10, the security pocket 172 includes a first portion 174 and a second portion 176, where the first portion 174 is separate from the second portion 176. In exemplary aspects, the second portion 176 is integrally formed with the pant 170, in contrast to the first portion 174, which is separate from the pant 170. In the aspect of FIGS. 9 and 10, the second portion 176 is integrally formed with the pant 170 such that the second portion 176 comprises the same material and/or fabric as the pant 170. Moreover, the second portion 176 may comprise fibers that are the same or similar to the fibers comprising the pant 170. In other words, the second portion 176 is seamlessly knit or woven as a continuous portion of the pant 170 material or fabric. The second portion 176 is not, therefore, a different material or fabric panel, but rather, is part of the continuous fabric panel(s) forming the pant 170. Additionally or alternatively, the second portion 176 may comprise the same fibers as the pant; however, a different weave or knitting technique may be employed at the second portion 176. Alternatively, the second portion 176 may include and/or incorporate one or more additional or different types of fibers in order to imbue the second portion 176 and fasteners thereof with increased rigidity, durability, strength, and/or fastening capability, in aspects, while maintaining the continuity of the fabric panels of the pant 170.

The second portion 176 may be formed by knitting, weaving, and/or treating fibers of the pant fabric at a location where the security pocket is desired to be placed, generally. The knitted, woven, and/or treatment of the fibers at said location(s) results in the formation of one or more fasteners 178 at the pant fabric's surface. In this way, the knitted, woven, and/or treated fibers correspond to an inner-facing surface 180 of the second portion 176. In exemplary aspects, the knitted, woven, and/or treated fibers exhibit fastening capability, whereas other fibers (e.g., untreated fibers) may not exhibit fastening capability, in aspects. Untreated fibers, in some exemplary aspects, might include other fasteners that are not integrally formed. As shown in FIGS. 9 and 10, the fibers forming the inner-facing surface 180 of the second portion 176 may have been treated or manipulated by knitting, weaving, brushing, cutting, knotting, or the like, in order to form one or more fasteners 178, generally. As such, the inner-facing surface 180 of the second portion 176 is overlaid with the one more fasteners 178 formed from the fibers at the surface itself. In one aspect, the treated fibers form one or more loop fasteners at the inner-facing surface of a second portion. In another aspect, the treated fibers form hook fasteners at the inner-facing surface of the second portion 176. Although hook-and-loop fasteners are depicted in the exemplary security pocket 172 of FIGS. 9 and 10, it will be understood that micro-hook and loop fasteners, or other types of fasteners, may be employed by the aspects described herein and are considered to be within the scope of the claimed invention.

As shown in FIG. 9, the security pocket 172 is in an open configuration where the first portion 174—which may comprise a separate, disparate, portion—is not releasably attached to the second portion 176. Similarly, in FIG. 10, the security pocket 172 is shown in an open configuration, as the first portion 174 is not releasably attached to the second portion 176. The first portion 174 of the security pocket 172 includes an inner-facing surface 182 having one or more fasteners 184 that are complementary to the one or more fasteners 178 of the second portion 176, in aspects. Generally, in a closed configuration, the one or more fasteners 184 and 178 contact one another and engage one another, such that the first portion 174 and the second portion 176 are releasably affixed to each other. As shown in FIG. 10, the illustrative dashed lines indicate where the one or more fasteners 178 of the second portion and the one or more complementary fasteners 184 of the first portion 174 may be aligned to one another so that said fasteners 184 and 178 of each portion 174 and 176 may be brought together to engage one another. In the closed configuration, access to an opening 187 (shown in FIG. 9) is limited or reduced, thereby securing stowed items therein.

Figure 11:
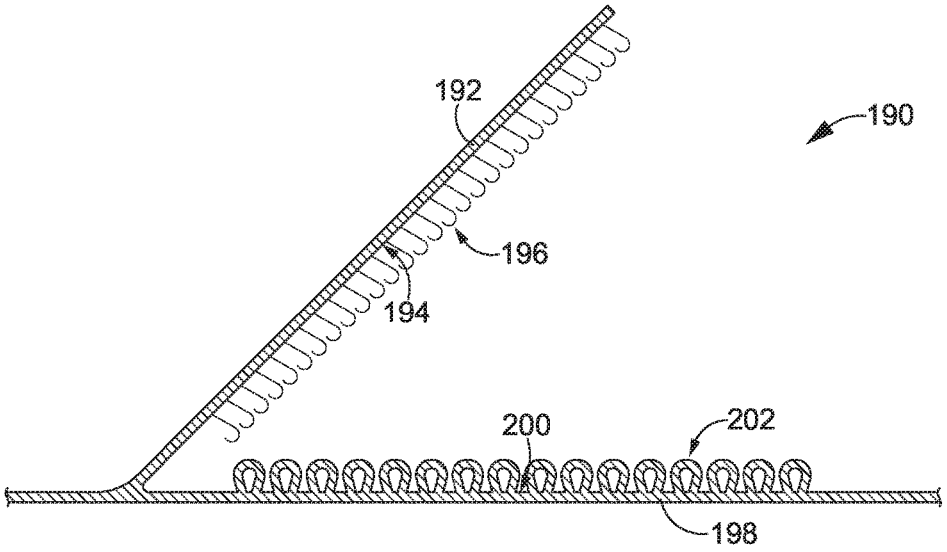
FIG. 11 depicts a cross section of an entirely integrally formed panel of a security pocket.

In another aspect, the entirety of a security pocket is integrally formed with a garment. For example, FIG. 11 depicts a cross section, taken in a plane that is the same as that shown in FIG. 10, of another security pocket 190 that is completely integrally formed with a garment (not shown). The security pocket 190 of FIG. 11 is shown in an open configuration. The security pocket 190 of FIG. 11 includes a first portion 192 having an inner-facing surface 194. The inner-facing surface 194 includes one or more fasteners 196, for example, hook fasteners or micro-hook fasteners, or alternatively, loop fasteners or micro-loop fasteners. The security pocket 190 further includes a second portion 198 having an inner-facing surface 200 that includes one or more fasteners 202 that are complementary to the one or more fasteners 196 of the first portion 192. In a closed configuration, the one or more fasteners 196 and 202 contact and engage one another, so that the first and second portions 192 and 198 are releasably attached to each other.

In FIG. 11, the first and second portions 192 and 198 are integrally formed with a garment (not shown) such that the security pocket 190 forms a continuous panel of fabric with the garment such that there are no seams between the garment and the pocket 190. And the inner-facing surfaces 194 and 200 of each portion 192 and 198, respectively, may include fibers treated so as to form fasteners and complementary fasteners that engage one another when the security pocket 190 is in a closed configuration.

The disclosure provided above is intended to illustrate some possible combinations of various aspects associated with the security pocket. Those skilled in the art will understand, however, that within each embodiment, some features may be optional. Moreover, different features discussed in different embodiments could be combined in still other embodiments and would still fall within the scope of the attached claims. Some features could be used independently in some embodiments, while still other features could be combined in various different ways in still other embodiments. The purpose served by the disclosure, however, is to provide an example of the various features and concepts related to the aspects described herein, not to limit the scope thereof. One skilled in the relevant art will recognize that numerous variations and modifications may be made to the configurations described above without departing from the scope of aspects described herein, as defined by the claims.

Having thus described the invention, what is claimed is:

1. A security pocket comprising:

a panel having a first portion, a second portion, and a hinge portion separating the first portion and the second portion, wherein:

the first portion comprises an inner-facing surface and an outer-facing surface, and wherein a majority of the inner-facing surface of the first portion is overlaid with one of hook fasteners or loop fasteners;

the second portion comprises an inner-facing surface and an outer-facing surface, wherein the majority of the inner-facing surface of the second portion is overlaid with fasteners that are complementary to the fasteners of the first portion, wherein the inner-facing surface of the second portion comprises one or more slit openings extending into a space formed between the inner-facing surface and the outer-facing surface of the second portion, and wherein a portion of the complementary fasteners of the second portion extend up to and surround the one or more slit openings; and the hinge portion is adapted to enable the first portion to be folded over onto the second portion such that the fasteners of the first portion engage the fasteners of the second portion;

wherein when the first portion is folded over onto the second portion, at least the portion of the complementary fasteners that extend up to and surround the one or more slit openings of the inner-facing surface of the second portion engage with a portion of the fasteners of the inner-facing surface of the first portion to seal the one or more slit openings and secure any items stowed therein.

2. The security pocket of claim 1, wherein the majority of the inner-facing surface of the first portion that is overlaid with the one of hook fasteners or loop fasteners is the same size and shape as the majority of the inner-facing surface of the second portion that is overlaid with the fasteners that are complementary to the fasteners of the first portion.

3. The security pocket of claim 1, wherein the hinge portion comprises a flexible material, and wherein when the first portion is folded over onto the second portion, at least one of the one or more slit openings is covered in its entirety by the first portion.

4. The security pocket of claim 1, wherein the inner-facing surface of the first portion is at least 75% overlaid with the one of hook fasteners or loop fasteners.

5. The security pocket of claim 1, wherein the inner-facing surface of the first portion is entirely overlaid with the one of hook fasteners or loop fasteners.

6. The security pocket of claim 1, wherein the one or more slit openings are sized to receive items for stowing in the space formed between the inner-facing surface and the outer-facing surface of the second portion.

7. The security pocket of claim 1, wherein the inner-facing surface of the second portion is at least 75% overlaid with the fasteners that are complementary to the fasteners of the first portion.

8. The security pocket of claim 1, wherein when the panel is in a closed configuration, the inner-facing surface of the first portion is releasably affixed to the inner-facing surface of the second portion, limiting access to the one or more slit openings of the second portion.

9. A garment having a security pocket, the garment comprising:

at least one fabric panel configured to cover at least an upper torso area of a wearer or a lower torso area of the wearer when the garment is in an as-worn configuration, wherein the security pocket is affixed to the at least one fabric panel, and wherein the security pocket comprises:

a panel having a first portion, a second portion, and a hinge portion separating the first portion and the second portion, wherein:

the first portion comprises an inner-facing surface and an outer-facing surface, and wherein at least 80% of the inner-facing surface of the first portion is overlaid with one of hook fasteners or loop fasteners;

the second portion comprises an inner-facing surface and an outer-facing surface, wherein the majority of the inner-facing surface of the second portion is overlaid with fasteners that are complementary to the fasteners of the first portion, and wherein the inner-facing surface of the second portion comprises one or more slit openings extending into a space formed between the inner-facing surface and the outer-facing surface of the second portion, and wherein a portion of the complementary fasteners of the second portion extend up to and surround the one or more slit openings; and the hinge portion is adapted to enable the first portion to be folded over onto the second portion such that the one of hook fasteners or loop fasteners of the first portion engage the fasteners of the second portion that are complementary to the fasteners of the first portion, wherein when the panel is in a closed configuration, at least the portion of the complementary fasteners that extend up to and surround the one or more slit openings of the inner-facing surface of the second portion engage with a portion of the one of hook fasteners or loop fasteners of the inner-facing surface of the first portion to seal the one or more slit openings and secure any items stowed therein.

10. The garment of claim 9, wherein when the panel is in the closed configuration, the first portion contacts at least a portion of the second portion at a location corresponding to the one or more slit openings.

11. The garment of claim 9, wherein when the panel is in an open configuration, the first portion does not contact the second portion such that the one or more slit openings are accessible, or the first portion contacts at least a portion of the second portion such that at least one of the one or more slit openings remains accessible.

12. The garment of claim 9, wherein at least one of the outer-facing surface of the first portion or the second portion is affixed to the garment.

13. The garment of claim 9, wherein the first portion further comprises a tab portion configured for manipulating the panel from the closed configuration to an open configuration, wherein the tab portion is not overlaid with the one of hook fasteners or loop fasteners.

14. The garment of claim 13, wherein the tab portion corresponds to at least a portion of a perimeter of the first portion of the panel.

15. The garment of claim 9, wherein the hinge portion does not include hook-and-loop fasteners.

16. The garment of claim 9, wherein the hinge portion comprises a flexible material.

17. The garment of claim 9, wherein the first portion and the second portion are symmetrical to one another, with respect to the hinge portion.

18. The garment of claim 9, wherein the garment comprises a pant.

19. The garment of claim 9, wherein the garment comprises a jacket.

20. A fold-over security pocket for stowing items, the security pocket comprising:

a panel adapted to be affixed to a garment, the panel having a first portion, a second portion, and a hinge portion separating the first portion and the second portion, wherein:

the first portion comprises an inner-facing surface and an outer-facing surface, and wherein at least 90% of the inner-facing surface of the first portion is overlaid with hook fasteners;

the second portion comprises an inner-facing surface and an outer-facing surface, wherein at least 90% of the inner-facing surface of the second portion is overlaid with loop fasteners, and wherein the inner-facing surface comprises one or more slit openings extending into a space formed between the inner-facing surface and the outer-facing surface of the second portion, the one or more slit openings sized to receive an item for stowing in the space, and wherein a portion of the loop fasteners of the second portion extend up to and surround the one or more slit openings; and the hinge portion is adapted to facilitate a closed configuration by enabling the first portion to be folded over onto the second portion such that the hook fasteners of the first portion engage the loop fasteners of the second portion and the one or more slit openings of the second portion are overlaid by the first portion, wherein when the first portion is folded over onto the second portion, at least the portion of the loop fasteners that extend up to and surround the one or more slit openings of the inner-facing surface of the second portion engage with a portion of the hook fasteners of the inner-facing surface of the first portion to seal the one or more slit openings and secure any items stowed therein.

* * * * *